United States Patent [19]

May

[11] 4,026,460

[45] May 31, 1977

[54] VALVE TYPE SHIPPING BAG

[75] Inventor: James A. May, Midland, Mich.

[73] Assignee: The Dow Chemical Company, Midland, Mich.

[22] Filed: May 3, 1976

[21] Appl. No.: 682,825

[52] U.S. Cl. ..... 229/62.5; 229/DIG. 14

[51] Int. Cl.[2] ..... B65D 31/14

[58] Field of Search ..... 229/62.5, DIG. 14; 150/9

[56] References Cited

UNITED STATES PATENTS

| | | | |
|---|---|---|---|
| 1,938,593 | 12/1933 | Jarrier | 229/62.5 |
| 2,105,376 | 1/1938 | Scott | 229/62.5 |
| 2,340,546 | 2/1944 | Meaker | 229/62.5 X |
| 3,357,632 | 12/1967 | Stanforth | 229/62.5 |
| 3,370,780 | 2/1968 | Show | 229/62.5 |
| 3,394,871 | 7/1968 | Williams et al. | 229/62.5 |
| 3,937,395 | 2/1976 | Lawes | 229/DIG. 14 X |

*Primary Examiner*—Stephen P. Garbe
*Attorney, Agent, or Firm*—M. B. Lilly; Earl D. Ayers

[57] ABSTRACT

A force flow valve type shipping bag including a vapor barrier ply, incorporating a valve-like sealable vent communicating between the exterior of the bag and the space between the vapor barrier ply and the inner wall plies of the bag.

10 Claims, 6 Drawing Figures

VALVE TYPE SHIPPING BAG

BACKGROUND OF THE INVENTION

This invention relates to force flow valve type multiply walled shipping bags which include in the bag wall an intermediate ply which is a vapor barrier, and particularly to such a bag having a sealable vent by passing the vapor barrier ply.

Force flow packaging with valve bags to increase flow rate and powder compaction is difficult, if not impractical to accomplish, due to the air release problem when the bag contains a vapor barrier.

Needle hole perforations in the vapor barrier have been used to alleviate the problem, but their presence destroys the integrity of the vapor barrier.

Without air relief from powder fill through the sides and bottom of the bag, compaction of the bag contents cannot be effected and the bag filling rate is impractically slow and cumbersome.

OBJECTS OF THE INVENTION

A principal object of this invention is to provide an improved valve type multiple ply bag having a vapor barrier ply.

Another object of this invention is to provide an improved, easier to fill valve type multiple ply bag having a vapor barrier ply.

A further object of this invention is to provide an improved valve type multiple ply bag having a vapor barrier ply which is easy to fill and maintains the integrity of the vapor barrier.

STATEMENT OF INVENTION

In accordance with this invention, there is provided a force flow valve type multiple wall ply, including a vapor barrier ply, shipping bag incorporating a valve-like sealable vent communicating between the exterior of the bag and the space between the vapor barrier ply and the inner wall part of the bag.

The vent tube or sleeve is situated between the folded inner and outer plies of the bottom of the bag including the vapor barrier ply and is sealed to the inner and outer wall structure of the bag. The vent valve sleeve is sealable at or near its outer end or along the entire length if desired, and may include a vapor barrier coating or wall. After filling the bag, the valve sleeve can be folded over and cemented to either the side or the bottom of the bag.

Alternatively the external type valve may be foreshortened to extend only to the edge of the outer overlapping outside bottom plies. A further modification resulting in an integral valve sleeve construction can be accomplished by restricting the initial glue application to leave an equivalent tube like vent passage that can be heat sealed after filling the bag. An alternative to restriction of the glue application can be the insertion during bag manufacture of a non-sticking removable sleeve such as waxed paper that will allow later sealing by the application of heat or pressure.

BRIEF DESCRIPTION OF THE DRAWING

The invention, as well as additional objects and advantages thereof, may best be understood when the following detailed description is read in connection with the accompanying drawing, in which.

DETAILED DESCRIPTION OF THE DRAWING

Figure 2:
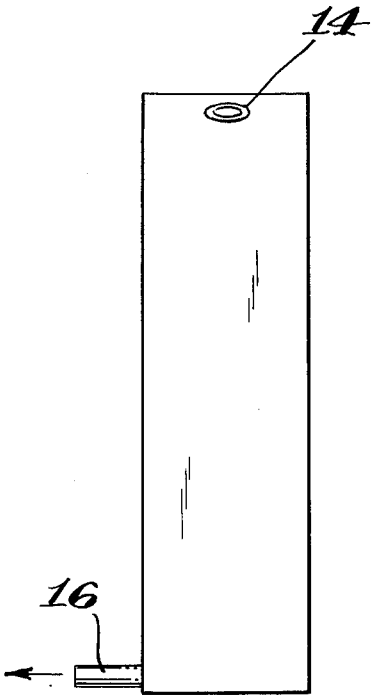
FIG. 2 is an end elevational view of the bag shown in FIG. 1.
Figure 1:
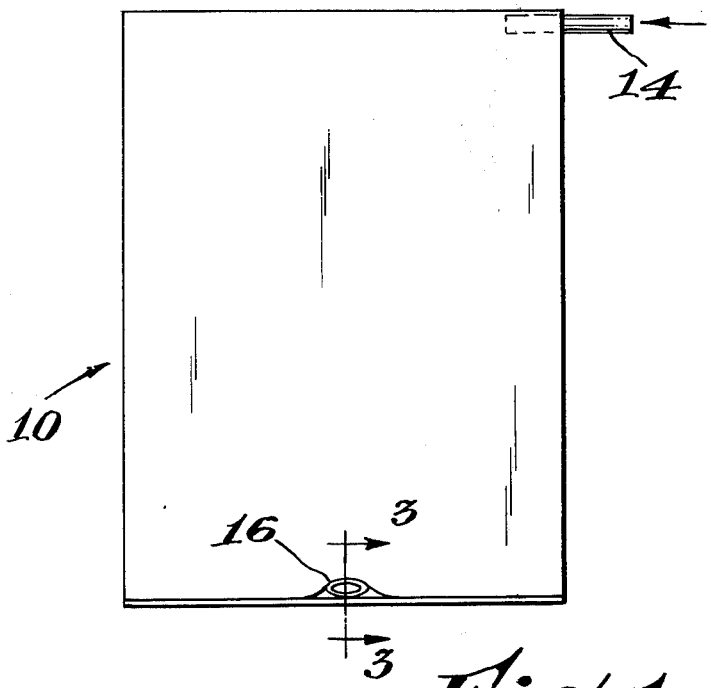
FIG. 1 is a side elevational view of a shipping bag in accordance with this invention.
Figure 3:
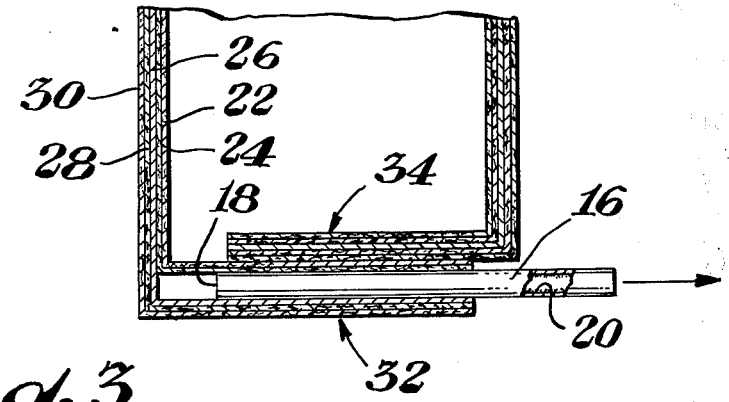
FIG. 3 is a fragmentary sectional view taken along the line 3–3 of FIG. 1.

Referring to the drawing, particularly to FIGS. 1, 2 and 3, there is shown a valve type shipping bag, indicated generally by the numeral 10, having a filling valve 14, vent 16, paper wall plies 22, 24, 28, 30, and vapor barrier ply 26 (made of metal foil or plastic film, for example).

The valve 14 is incorporated into the top of the bag 10 and extends outwardly from a side of the bag, as is well-known in the shipping bag art.

Figure 6:
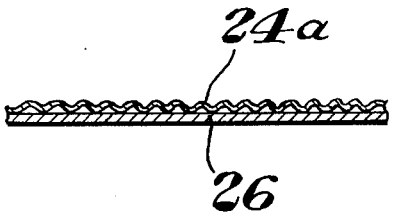
FIG. 6 is a fragmentary sectional view showing a corrugated paper ply adjacent to a vapor barrier ply.

The vent 16 extends from the side of the bag 10 and is made of tubular material similar to the valve 14. The tubular material of the vent 16 is inserted and sealed between overlapping ply bottom parts 32, 34 with the inner end 18 of the vent extending beyond the overlapping parts 32, 34 to permit air flow through the paper inner plies 22, 24 into the vent 16. The vapor barrier ply 26 is next adjacent to the vent 16, the outer paper plies 28, 30 lying next to the vapor-barrier ply. Inner ply 24 may be ribbed in any suitable manner as shown by the ply **24*a* adjacent to a vapor barrier ply 26 in FIG. 6 in order to improve air passage into the vent 16. The inner surface of the vent 16 may be provided with a vapor barrier and/or sealing layer 20 along all, or only the part of the vent 16 (if any) which extends beyond the bag 10,** which may be closed by heat, pressure or any convenient means.

Figure 4:
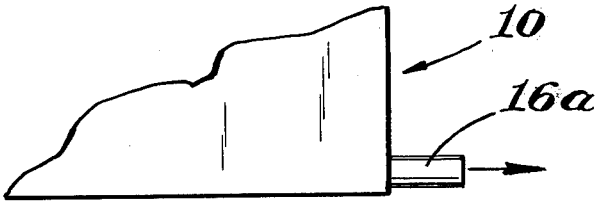
FIG. 4 is a fragmentary side elevational view of a bag in accordance with this invention in which the vent extends from an end of the bag.

FIG. 4 shows an alternative location of the vent tube **16*a* at the end of a bag 10*a* rather than at the lower side as in FIG. 1.**

In this embodiment the vent may, for example, extend from the end of the bag into the area shown in FIG. 3 at the lower left part of the figure where the wall parts of the bag are not overlapped.

Figure 5:
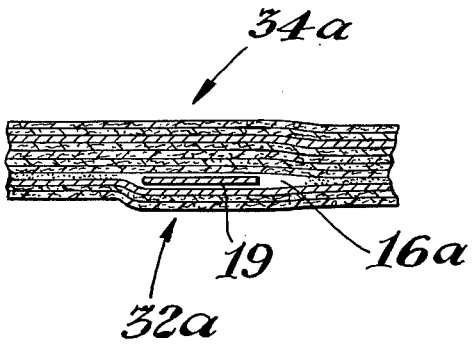
FIG. 5 is a fragmentary bottom side elevational view, in section 1 of an integral vent in accordance with this invention.

FIG. 5 illustrates another embodiment of a bag having venting means in accordance with this invention. In this embodiment the venting means is integral with the conventional vapor barrier bag construction and is composed of an unsealed area extending from the exterior of the bag past the inner end of the overlapped bottom part 34 (in FIG. 3). Thus, venting means **16*a* is accomplished without a separate walled vent "tube" as shown in FIGS. 1–4.**

The plies (vapor barrier ply and next adjacent inner porous ply) may each or both have an adhesive coating on opposed surface parts which are kept separated by a slip sheet 19 which is removed after the bag is filled — or the vent may be sealed by passing the bottom of the bag over a heat sealer, for example, in event the plies having opposed heat sealing surfaces.

OPERATION

In operation, the bag 10 is force flow loaded through the inlet valve 14. The pressurized air in the bags escapes through the inner porous (to air) paper plies 24, 26, and then escapes through the vent 16.

The relatively rapid escape of the pressurized air through the vent 16 permits compaction of the bag contents and makes practical, from a time standpoint, the force flow filling of shipping bags which have a vapor barrier wall ply.

After filling, the valve 14 and vent 16 are sealed, assuring the integrity of the vapor barrier in the bag.

What is claimed is:

1. A valve fill type shipping bag having top, bottom, ends and sides comprising multi-ply walls including a vapor barrier ply sandwiched between gas permeable wall plies, closable filling valve means, and sealable gas venting means extending between said vapor barrier ply and those gas permeable plies which are between the interior of the bag and said vapor barrier ply, said venting means communicating with the exterior of said bag.

2. A shipping bag in accordance with claim 1, wherein said gas venting means is a generally tubular member having a vapor barrier disposed at least along the part of it which communicates with the exterior of said bag.

3. A shipping bag in accordance with claim 2, wherein said tubular member is made of paper.

4. A shipping bag in accordance with claim 2, wherein said tubular member is made of heat sealable plastic material.

5. A shipping bag in accordance with claim 1, wherein said venting means is disposed at the bottom part of said bag and extends outwardly from a side of said bag.

6. A shipping bag in accordance with claim 1, wherein said venting means is disposed at the bottom of said bag and extends outwardly from an end of said bag.

7. A shipping bag in accordance with claim 1, wherein said venting means includes a sealing part.

8. A shipping bag in accordance with claim 1, whrein said gas permeable plies are made of paper.

9. A shipping bag in accordance with claim 1, wherein said venting means is an integral part of said bag plies comprising an unsealed section between said vapor barrier ply and the next adjacent inner ply in the bottom of said bag which defines a passageway communicating between the exterior of the bag and the space between the vapor barrier and the next adjacent inner ply.

10. A shipping bag in accordance with claim 9, wherein a slip sheet is disposed between said unsealed plies.

* * * * *

UNITED STATES PATENT AND TRADEMARK OFFICE

CERTIFICATE OF CORRECTION

PATENT NO. : 4,026,460
DATED : May 31, 1977
INVENTOR(S) : James A. May

It is certified that error appears in the above-identified patent and that said Letters Patent are hereby corrected as shown below:

In column 2, line 36, delete "The" after the period. Start a new paragraph and insert --The-- in front of inner surface of the vent 16.

In column 2, line 64, delete "having" and insert --have--.

In column 4, line 14, delete "whrein" and insert --wherein--.

Signed and Sealed this

*Twenty-seventh* Day of *September 1977*

[SEAL]

*Attest:*

RUTH C. MASON
*Attesting Officer*

LUTRELLE F. PARKER
*Acting Commissioner of Patents and Trademarks*